US005526898A

United States Patent [19]

Clark

[11] Patent Number: 5,526,898

[45] Date of Patent: Jun. 18, 1996

[54] LEG EXTENSION ASSEMBLY

[76] Inventor: Allen Clark, 106 Clearview St., Clinton, Tenn. 37716

[21] Appl. No.: 268,120

[22] Filed: Jul. 6, 1994

[51] Int. Cl.[6] ..... E06C 7/00

[52] U.S. Cl. ..... 182/200; 182/108; 248/188.2

[58] Field of Search ..... 182/200, 201, 182/202, 203, 204, 108, 62.5, 166, 211; 248/188.2, 649

[56] References Cited

U.S. PATENT DOCUMENTS

| | | | |
|---|---|---|---|
| 1,177,069 | 3/1916 | Verow et al. | 182/203 |
| 1,259,239 | 3/1918 | Jecklin | 182/201 X |
| 1,290,690 | 1/1919 | Watson | 182/201 X |
| 1,733,338 | 10/1929 | Enke | 182/204 |
| 2,608,794 | 9/1952 | Matter | 182/201 X |
| 2,911,134 | 11/1959 | Derby et al. | 182/201 |
| 4,037,367 | 2/1978 | Wright | 182/204 |
| 4,607,726 | 8/1986 | Davis et al. | 182/204 |

FOREIGN PATENT DOCUMENTS

| | | | |
|---|---|---|---|
| 596478 | 7/1959 | Italy | 182/201 |

*Primary Examiner*—Karen J. Chotkowski
*Attorney, Agent, or Firm*—Peter A. Borsari

[57] ABSTRACT

The present invention relates to leg extension assembly comprising an outer sleeve member having a box leg member disposed therein, a telescopically collapsible inner leg member slidably mounted within said sleeve member, means for connecting said box leg member to said inner leg member, said means including a spring element which biases the inner leg member away from the box leg, and locking means for locking said inner leg at a selected extended length. The leg extension assembly may be incorporated into a leg element, or in the alternative, may be attached or otherwise affixed to an existing leg, such as an existing leg of, for example, a ladder, scaffold, sawhorse, table or chair by any means well known in the art.

18 Claims, 4 Drawing Sheets

FIG. 1
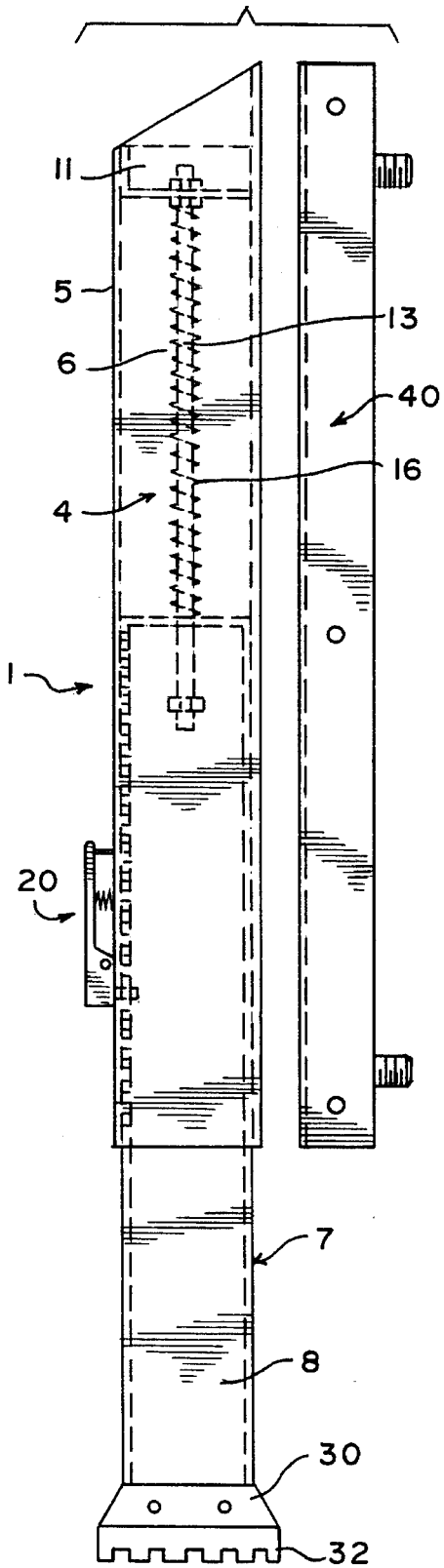
FIG. 2
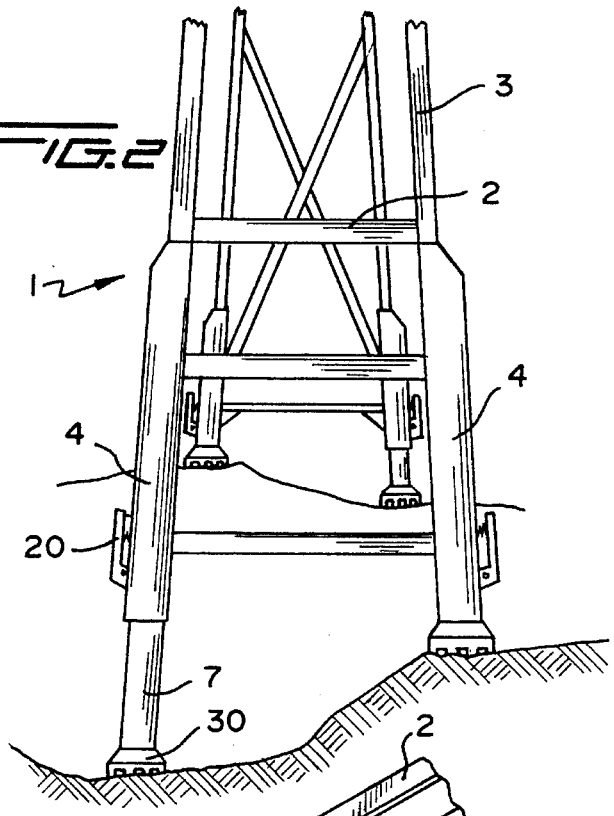
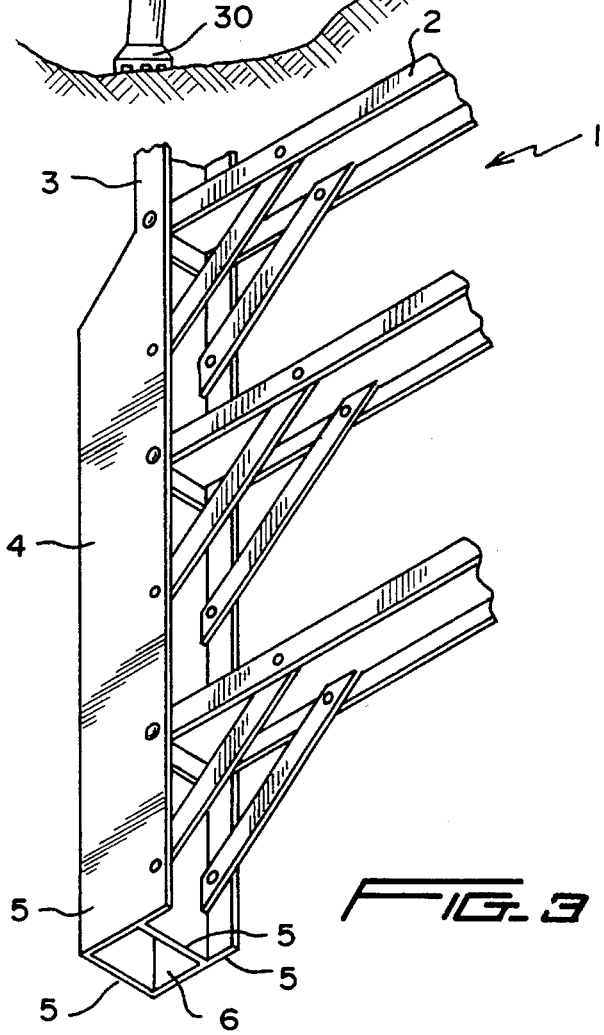
FIG. 3

LEG EXTENSION ASSEMBLY

FIELD OF INVENTION

The present invention relates to leg extension assembly which may be incorporated within a leg structure or may be adapted for use with any existing leg structure. More particularly, the present invention relates to leg extension assembly which provides a simple means to extend the length of a leg and to lock the extending leg into position.

BACKGROUND OF THE INVENTION

Ladder leg extenders and levelers are well known in the art. Attention is directed, for instance, to U.S. Pat. No. 3,933,222 to Craig, Jr., wherein a ladder leg extender/leveler is disposed in a sleeve-like arrangement around the outside of a standard ladder leg, and includes a latching mechanism to hold the device in place. U.S. Pat. No. 4,766,976 to Wallick, Jr., also teaches the use of a leveler/extender device associated with a ladder leg, wherein the device is locked in place by clamp plates biased against the leveler/extender by a spring. Another device typical of this art, U.S. Pat. No. 1,733,338 to Enke, teaches a ladder leg leveler/extender wherein the leveler/extender includes a spring-bias and a latch, but wherein the spring is biased to pull the leveler/extender to a retracted position. Extending the device outwardly from the ladder leg then requires effort by the user to act against the retracting bias of the spring. Such effort can be difficult when the user is on uneven ground and burdened by other equipment.

The present invention recognizes the need for a simplified design for ladder leg leveler/extenders which allows for ease of use and economy of design. The unique layout for the instant invention exhibits a simple and economical design, ease of use, as well as additional safety features inherent to the structure.

SUMMARY OF THE INVENTION

Accordingly, it is an object of the present invention to provide a leg extension assembly which may be attached to an existing leg element of a table, chair, ladder, saw horse or similar structure in order to provide means for extending the length of said leg.

It is another object of the present invention to provide a leg extension assembly which may be incorporated within a leg structure of a table, chair, ladder, saw horse or similar structure in order to provide means for extending the length of said leg.

It is still another object of the present invention to provide a leg extension assembly which may be attached and unattached to an existing leg element in a simple and easy manner by means of a cinch belt assembly.

It is a further object of the present invention to provide a leg extension assembly which may be attached and bolted to an existing leg element.

It is an additional object of the present invention to provide a leg extension assembly whereby the leg may be extended simply by pulling a pivoting release lever.

It is yet another object of the present invention to provide a leg extension assembly whereby the leg may be extended to varying lengths and locked into place.

Additional objects, advantages and novel features of the invention will be set forth in the description which follows, and will become apparent to those skilled in the art upon examination of the following specification or may be learned by practice of this invention.

These and other objects of the invention, as embodied and broadly described herein, are achieved by providing a leg extension assembly comprising an outer sleeve member having a box leg member disposed therein, a telescopically collapsible inner leg member slidably mounted within said sleeve member, means for connecting said box leg member to said inner leg member, said means including a spring element which biases the inner leg member away from the box leg, and locking means for locking said inner leg at a selected extended length. The leg extension assembly may be incorporated into a leg element, or in the alternative, may be attached or otherwise affixed to an existing leg, such as an existing leg of, for example, a ladder, scaffold, sawhorse, table or chair by any means well known in the art.

BRIEF DESCRIPTION OF THE DRAWINGS

The present invention will be better understood with reference to the appended drawing sheets, wherein:

FIG. 1 shows a perspective view of the leg extension assembly of the present invention.

FIG. 2 shows a frontal view of the lower portion of a ladder structure positioned on an uneven surface showing the disposition of the leg extension assembly incorporated therein.

FIG. 3 is a perspective view of the ladder structure having wherein an outer sleeve member is incorporated at the lower end of a ladder leg.

DETAILED DESCRIPTION

Figure 4:
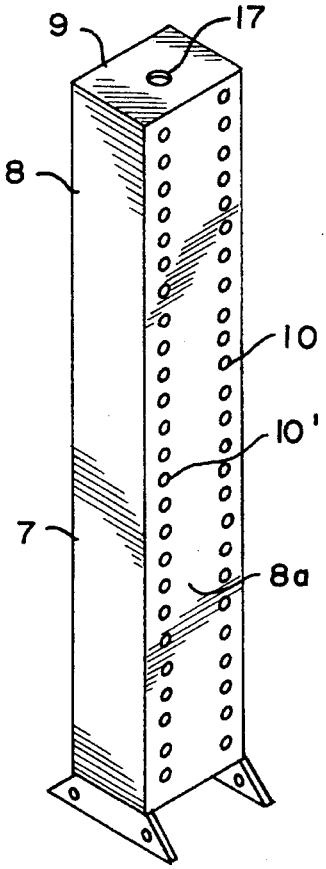
FIG. 4 is a perspective view of the inner leg member of the leg extension assembly.

The present invention relates to leg extension assembly comprising an outer sleeve member having a box leg member disposed therein, a telescopically collapsible inner leg member slidably mounted within said sleeve member, means for connecting said box leg member to said inner leg member, said means including a spring element which biases the inner leg member away from the box leg, and locking means for locking said inner leg at a selected extended length. The leg extension assembly may be incorporated into a leg element, or in the alternative, may be attached or otherwise affixed to an existing leg, such as an existing leg of, for example, a ladder, scaffold, sawhorse, table or chair by any means well known in the art.

In order to adjust the ladder structure on uneven ground, a locking assembly having a release lever is provided which springs or releases the leg to the desired position. The release lever includes a tooth, pawl or other similar extension, which cooperates with the pre-drilled holes of the inner leg to hold the inner leg assembly in place. The tooth, pawl or extension assemblies may be notched on its upper side in order to provide a safe and secure fit within the pre-drilled holes. At one end of the release lever is a second safety feature, in the form of a flip-over latch, which holds the release lever in position, and which thus provides additional protection in the event the release lever is accidently bumped.

As shown in FIG. 1, the leg extension assembly 1 comprises an outer sleeve member 4 having side walls 5, said side walls defining a cavity 6, a box leg member 11, affixed within the upper end portion of outer sleeve member 4, a telescoping inner leg member 7 which is slidably mounted within said sleeve 4 by means of a rod 13 which connects the box leg member with the inner leg member, said rod having a spring element 16 which biases the inner leg member away from the box leg member, and a locking assembly 20 for securing the inner leg member 7 at a pre-selected position. The lower end of the inner leg member 7 terminates into a foot assembly 31, preferably provided with a tough, roughened boot 32, which may be composed of, for example, rubber or any other resilient, slide resistant plastic. The foot assembly may be secured to inner leg member 7 in any manner known in the art, and preferably is pivoted. In the embodiment shown in FIG. 1, the leg extension assembly 1 can be attached to an existing leg of, for example, a ladder, by means an adaptor cover 40 in order to provide the existing leg with extension capability.

The leg extension assembly 1 of the present invention may be incorporated into a leg element, rather than being attached thereto. For example, as shown in FIGS. 2 and 3, the leg extension assembly 1 is incorporated within a ladder structure. However, it is to be understood that the leg extension assembly of the present invention can be incorporated into (or attached) to any desirable existing leg, including for example, the leg of a desk, table, chair, workbench, scaffold and the like. The outer sleeve member 4 is built into the lower portion of an actual leg of a ladder structure. In this embodiment, the requirement for an adaptor cover 40 is eliminated. More specifically, FIGS. 2 and 3 illustrate the leg extension assembly 1 incorporated within a main frame ladder assembly constructed of a plurality of steps or rungs 2 supported between side frames or legs 3. The lower portions of said side frames 3 terminate into outer sleeve members 4 having side walls 5, said side walls defining a cavity 6.

As illustrated in FIG. 4, the inner leg member 7 comprises side walls 8 and top wall 9, at least one side wall 8a being fashioned with a plurality of apertures 10. Preferably, the side wall 8a comprises a series pre-drilled holes, or other similar constructs, including, for example, sockets, sheet-metal punch-outs, or welded bars, which allow a rod or any other latching device to engage with the holes or other said similar constructs, which will hereinafter be referred to simply as apertures 10. Apertures 10 are positioned along the length and breadth of side wall 8a at evenly spaced intervals. In the preferred embodiment, there are two columns of apertures 10, 10'; however, it is to be understood that one column of apertures, preferably centered along the length of the inner leg member 7 is also within the scope of the present invention.

Inner leg member 7 may be constructed of four side walls 8 and a top wall 9 in order to provide the inner leg member with maximum structural rigidity, but it may be constructed in any other manner, as for instance by only three sides, as long as structural rigidity and integrity of the inner leg is maintained. Sidewalls 8 and top wall 9 may be constructed separately, or may be formed all on a single sheet. Top wall 9 is provided with a centrally located hole or aperture 17.

The inner leg member 7 is slidably mounted within the outer sleeve member 4 by means of a rod 13 or similar device which connects inner leg member 7 to the box leg member 11. Box leg member 11 is positioned at the upper portion of the outer sleeve member 4 in any manner known in the art, and may be constructed as part of the outer sleeve member 4 as shown in FIG. 1, or may be affixed within the upper portion, such as by screws as shown in FIG. 6.

Figure 5:
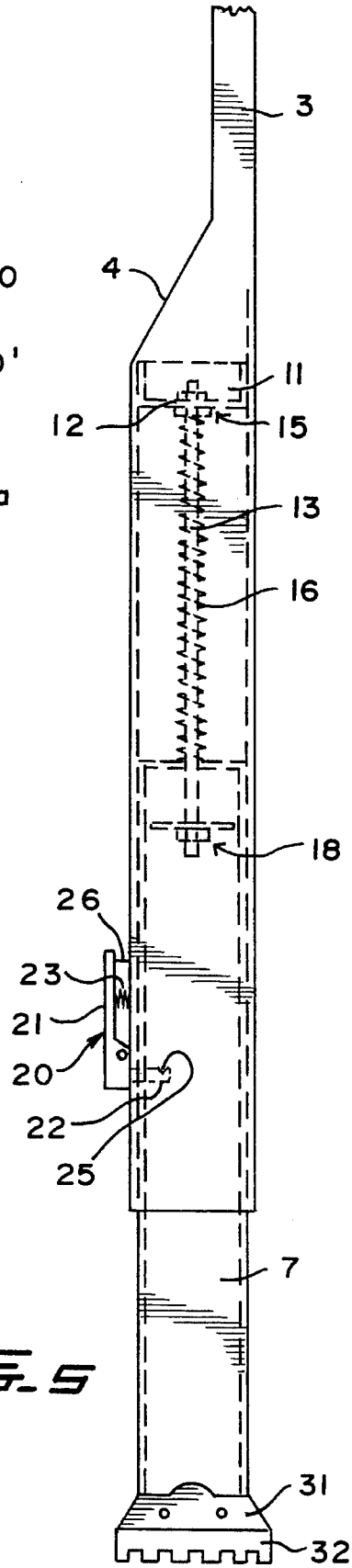
FIG. 5 is a perspective view of the leg extension assembly showing the position of the rod and spring in the extended position.
Figure 6:
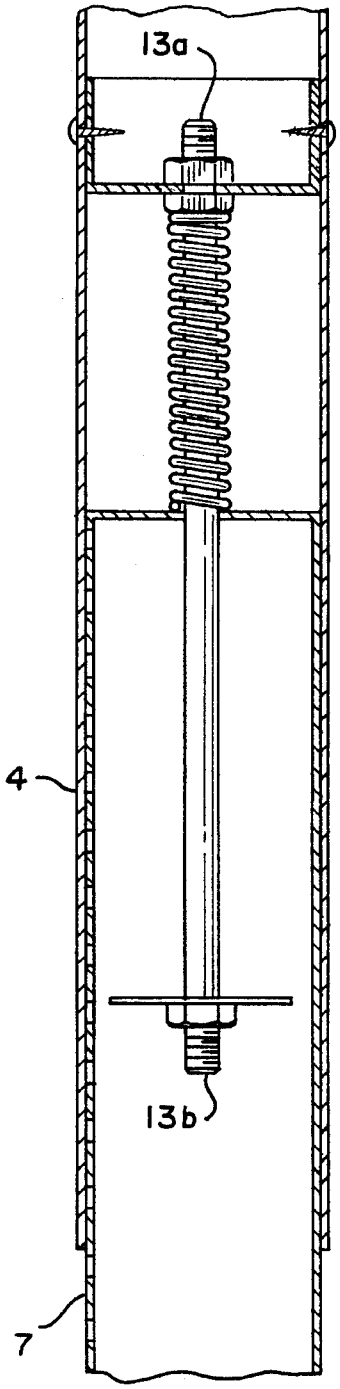
FIG. 6 is a frontal view of the leg extension assembly showing the position of the rod and spring in the retracted position.

FIGS. 5 and 6 illustrate the assemblies in extended and retracted positions, respectively. The rod member 13 is constructed such that opposing ends 13*a* and 13*b* are threaded. In this manner, the upper end of rod 13 is securely fastened to box leg member 11 through hole 12 by a lock nut and washer assembly 15 in a known manner. Rod member 13 passes downwardly through cavity 6 within the outer sleeve member 4 maintaining a substantially parallel relationship with the side walls 5. A spring element 16 is disposed on and around rod 13 such that the upper portion of spring element 16 biases against assembly 15. Inner leg member 7 is slidably mounted onto rod 13, with rod 13 passing through hole 17 located on upper wall 9 of the inner leg member. The lower end of spring element 16 biases against upper wall 9 of the inner leg member 7. A second lock nut and washer assembly 18 is located at the bottom of rod 13 and secured to lower threaded portion 13*b* of rod 13.

As shown in FIG. 5, the leg extension assembly 1 is in an extended position, with the inner leg member 7 stopped from further extension by locking assembly 20. The locking assembly 20 is secured or otherwise fastened to outer sleeve member 4 by means well known in the art, such as pivot means, and comprises a handle or release lever 21, comprising a spring element 23 which biases the locking assembly to an "engaged" position whereby a tooth or pawl 22 is introduced into one of the apertures 10 provided on the side wall 8*a* of inner leg member 7. Preferably, the locking assembly 20 comprises two (2) teeth or pawls 22 which engage parallel apertures 10, 10' on side wall 8*a* of inner leg member 7. The locking mechanism may further comprise a safety latch 26. In the preferred embodiment, the teeth or pawls 22 are provided with at least one notch 25 disposed on the upper surface thereof, said notch(es) serving to secure the teeth 22 from movement out of holes 10.

In operation, the ladder structure having the leg extension assembly 1 incorporated therein, is moved to a location for use with the leg extension assembly 1 in the retracted position, as shown, for example, in FIG. 6. In those instances where the ground or floor is uneven, the release lever 21 of the locking assembly 20 located on the outer sleeve member 4 not resting on the ground, is grasped and pivoted outwardly in order to the disengage the teeth or pawls 22 from apertures 10. Once the teeth or pawls 22 have been so disengaged, the inner leg member 7 automatically is extended in a downward direction, due to the biasing action of spring element 16 until boot 31 comes to rest on the ground or floor. The handle 21 thereafter is released and pivots back inwardly against the biasing action of spring element 23 and teeth or pawls 22 are introduced into apertures 10 of inner leg member 7. In this manner, the inner leg member 7 is locked into a new and extended position. In the preferred embodiment, the locking assembly 20 then may be secured into place by flip-over-latch safety latch 26.

The safety latch 26 maintains locking assembly 20 in the engaged position and prevents any inadvertent release of locking assembly. In the preferred embodiment, the flip-over-latch safety latch 26 is of simple design for ease of use, but may be substituted by any known suitable safety locking device.

It can be readily seen that the outward biasing action of spring 16 on the inner leg member 7 makes the leg extension assembly of the present invention easy to use and preferable to known devices. The locking assembly 20 does not include any complex moving parts, can be manipulated with one hand and provides protection from inadvertent disengagement of the latch.

As stated above, the leg extension assembly of the present invention may be incorporated into a leg element, for example, a leg of a ladder structure, or may be a stand alone assembly with means for attachment to an existing leg of, for example, a ladder, table, chair or the like. The leg extension assembly may be attached to an existing leg element by any number of means known in the art. Such attachment means include, for example, the use of an cover adaptor which may be affixed to or incorporated into the outer sleeve member. In this manner, the leg extension assembly can be attached to an existing leg element by a variety of means, including, for example, a simple nuts and bolts fastening means, or a cinch belt attachment means, a hinged stud bolt attachment means or a U-bolt attachment means wherein the leg extension assembly can be quickly and easily attached to and from the existing leg element.

Figure 8:
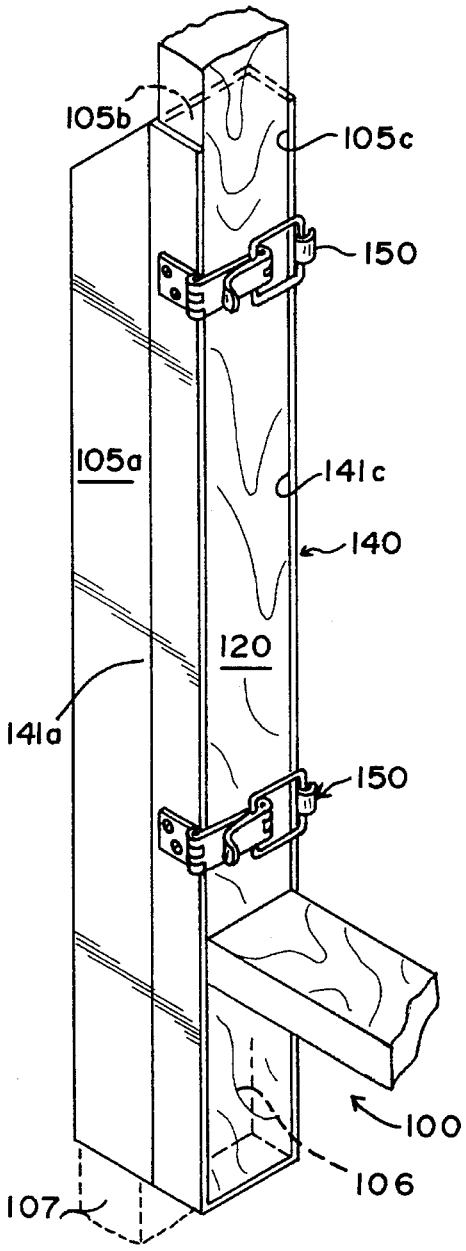
FIG. 8 is a perspective view of a cinch belt attachment means of the leg extension assembly.
Figure 7:
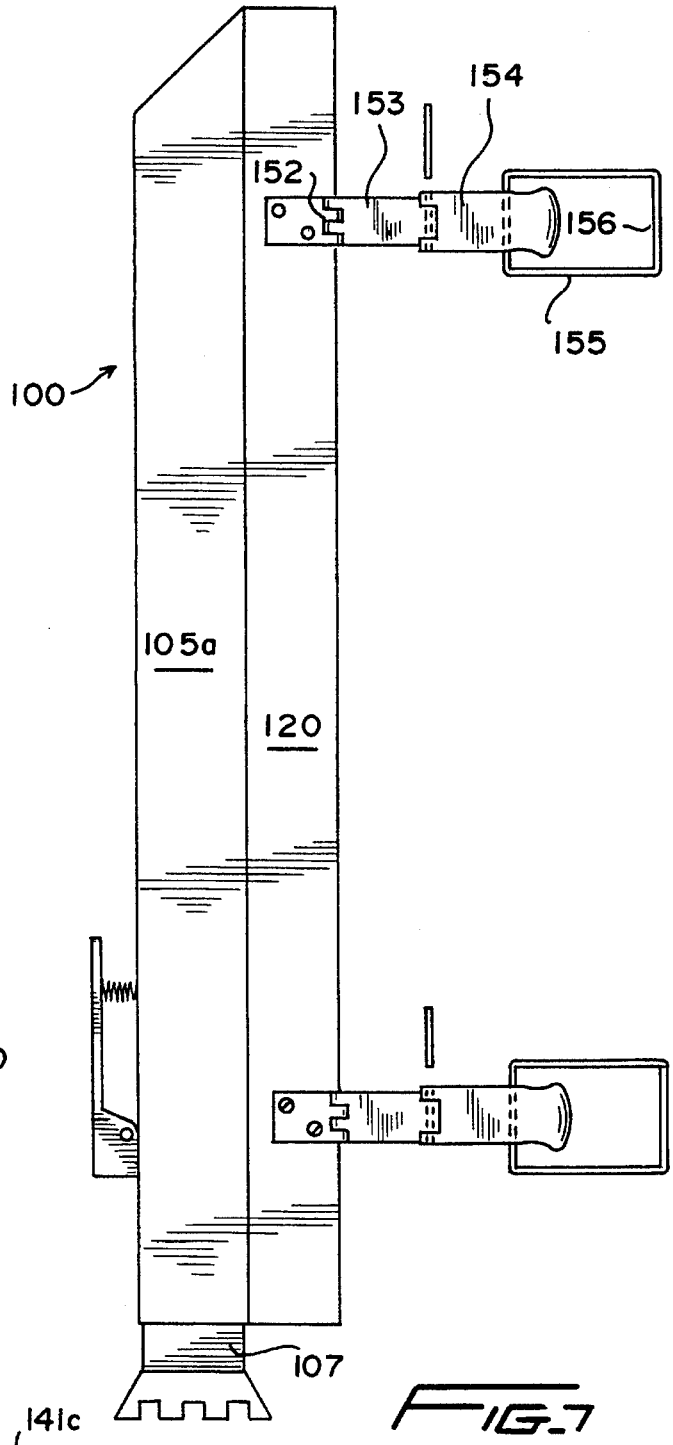
FIG. 7 is a perspective view of a cinch belt attachment means of the leg extension assembly.
Figure 9:
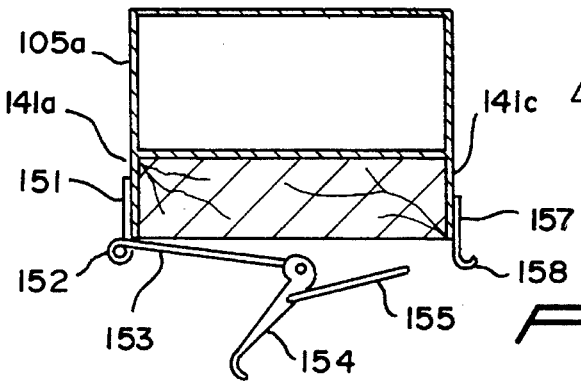
FIG. 9 is a top view of the cinch belt attachment means.

FIGS. 7, 8 and 9 illustrate the leg extension assembly of the present invention being attached to an existing leg element by means of a cinch belt assembly. The leg extension assembly 100 comprises an outer sleeve member having at least three side walls, 105*a*, 105*b* and 105*c*, all of which form space or cavity 106 into which inner leg member 107 is slidably mounted in a manner identical to that described above with respect to the ladder structure. The outer sleeve member further comprises an adaptor cover 140 which may be affixed to the outer sleeve member by any manner known in the art, such as, for example, by nuts and bolts. Preferably, the adaptor cover is incoporated into the outer sleeve member such that it forms one of the side walls 105. As illustrated in FIG. 8, the adaptor cover comprises side walls 141*a* and 141*c* which are part of and extend from side walls 105*a* and 105*c*. The leg extension assembly 100 is attached to a ladder leg 120 by a cinch belt assembly, 150. Cinch belt assembly 150 comprises a plate element 151 mounted to side wall 141*a*, said plate element including a hinge element 152 having a strap portion 153 extending therefrom and in pivotal relationship with mounting plate 151. Cinching latch portion 154 is positioned at the end of strap portion 153 and includes locking element 155 extending therefrom and in pivotal relation to latch portion 154. Locking element 155 is preferably an open wire arrangement, such as in the form of, for example, a loop, having an end 156. Mounted to side wall 141*c* is a plate element 157 having a hook 158 at the distal end thereof, and bent outwardly to engage locking element 155. In operation, the cinching latch 154 is engaged and the leg extension assembly 100 is locked into place over said leg element 120.

Figure 10:
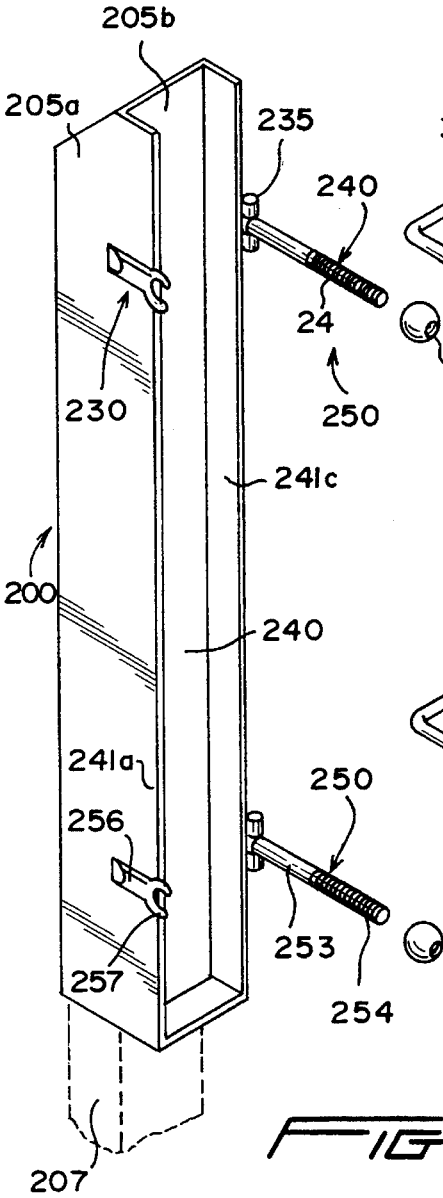
FIG. 10 is a perspective view of the leg extension assembly having a nut & bolt attachment means.
Figure 11:
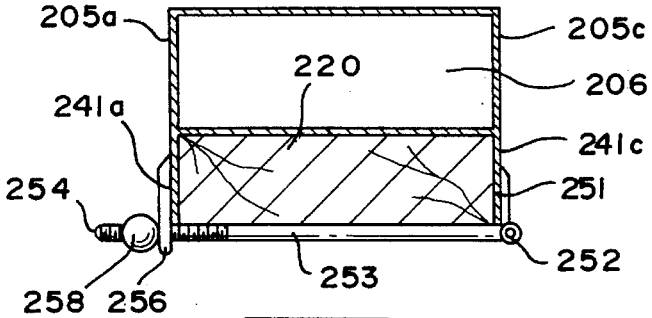
FIG. 11 is a top view of the leg extension assembly having a U-bolt attachment means.

FIGS. 10 and 11 illustrate another embodiment for attaching the leg extension assembly to an existing leg element wherein a hinge stud bolt assembly is used. The hinge stud bolt assembly, generally referred to as 250, is mounted to the cover adaptor 240 in the same manner as the cinch belt assembly 150, as shown in FIG. 10 wherein the leg extension assembly 200 comprises at least three side walls, 205*a*, 205*b*, and 205*c*, which together form space or cavity 206 into which inner leg member 207 is slidably mounted as described above. Side walls 205*a* and 205*c* include side portions 241*a* and 241*b* which form part of cover adaptor 240 and which extend outwardly from ladder extension assembly 200 and engage the sides of the existing leg element 220 in the manner shown. The hinge stud bolt assembly 250 comprises a plate element 251 mounted to side wall 241*c*, said plate element including a hinge element 252 having a bolt member 253 extending therefrom and in pivotal relationship with mounting plate 251 and including a threaded portion 254 at the distal end thereof. Mounted to side wall 241*a* is a locking plate element 256 which terminates into a bolt receiving element 257, such as in the form of a hook, at the distal end thereof, such that bolt member 253 can be introduced into or otherwise engage locking element 256 as bolt member 253 pivots into place. Nut 258 is then threaded over threaded end portion 254 and into tight relation with locking element 256, thereby locking assembly 200 into place.

Figure 12:
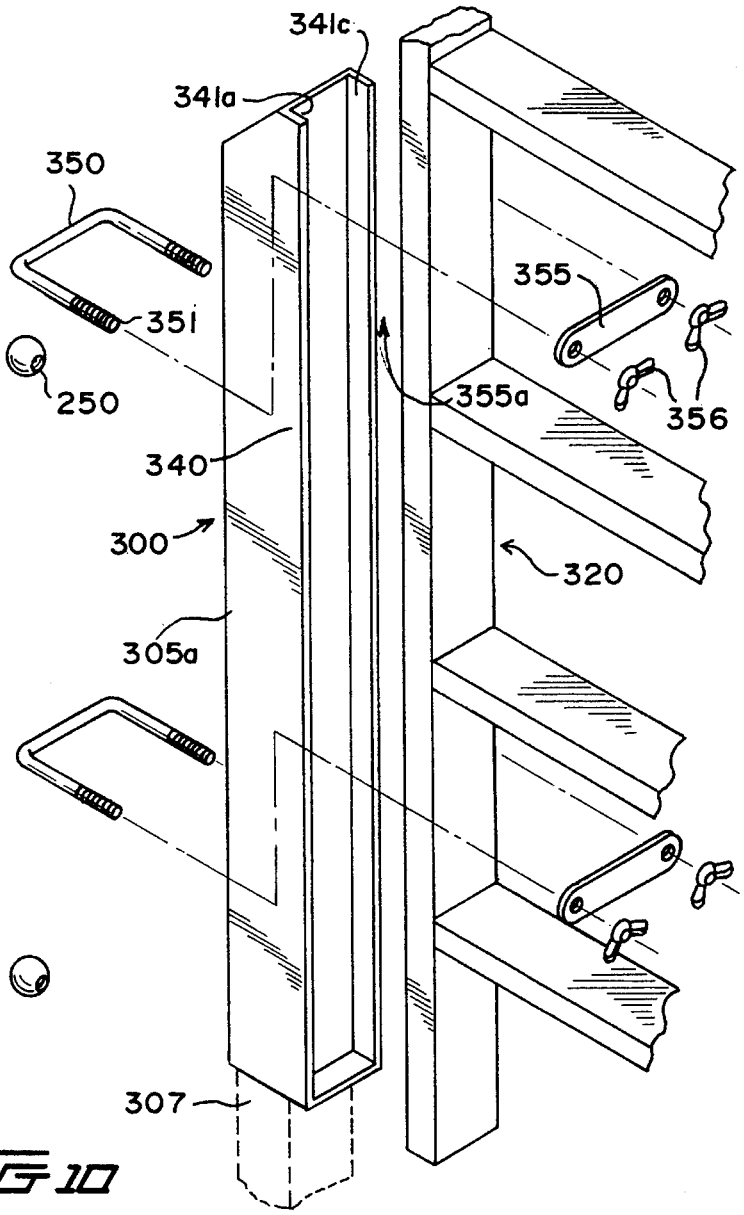
FIG. 12 is a perspective view of the leg extension assembly having a U-bolt assembly attachment means.

FIG. 12 illustrates a further embodiment for attaching the leg extension assembly to an existing leg element wherein a U-bolt assembly is is mounted over the cover adaptor 340 in order to secure the leg extension assembly in place. Referring to FIG. 12, a leg extension assembly 300 comprises at least three side walls, 305*a*, 305*b*, and 305*c*, which together form space or cavity 306 into which inner leg member 307 is slidably mounted as described above. Side walls 305*a* and 305*c* include side portions 341*a* and 341*b* which form part of cover adaptor 340 and which extend outwardly from ladder extension assembly 300 and engage the sides of the existing leg element 320 in the manner shown. The U-bolt assembly comprises U-bolt 350 having two threaded end portions 351 which wrap around ladder extension assembly 300 and existing ladder 320. Washer-bridge 355 is provided into which threaded portions 351 are placed. Nuts 356 then are threaded onto threaded portions 351 and into tight engagement with washer-bridge 355.

While particular embodiments of the invention have been described, it will be understood, of course, that the invention is not limited thereto, and that many obvious modifications and variations can be made, and that such modifications and variations are intended to fall within the scope of the appended claims.

What is claimed is:

1. A leg extension assembly comprising (a) an outer sleeve member having a box leg member disposed therein;

(b) an inner leg member having a series of apertures along at least one sidewall thereof, said inner leg member being slidably mounted within said outer sleeve member;

(c) means for connecting said box leg member to said inner leg member, said means including a spring element which biases said inner leg member away from said box leg member; and (d) a locking assembly comprising a release lever and at least one tooth which is fashioned to engage an aperture disposed in said sidewall.

2. The leg extension assembly according to claim 1 further comprising an adaptor cover having means to attach said assembly to a separate existing leg element.

3. The leg extension assembly according to claim 2, wherein said means is in the form of at least one cinch buckle.

4. The leg extension assembly according to claim 2, wherein said cover is bolted to said existing leg element by means of a nuts and bolts assembly.

5. The leg extension assembly according to claim 2, wherein said cover is bolted to said existing leg element by means of a U-bolt assembly.

6. The leg extension assembly according to claim 1, wherein said outer sleeve member is incorporated into a leg element.

7. The leg extension assembly according to claim 1, wherein said means for connecting said box leg member and said inner leg member is in the form of a rod which is threaded at each end.

8. The leg extension assembly according to claim 1, wherein said release lever is a pivoting release lever comprising an upper end a having a spring element biasing said release lever into an engaged position, and a lower end having at least one tooth extending therefrom, said tooth being fashioned to engage an aperture in said inner leg member.

9. The leg extension assembly according to claim 8, further comprising a safety latch for holding said release lever against movement.

10. A leg extension assembly comprising:

(a) an outer sleeve member having a box leg member disposed therein;

(b) a rod positioned within said sleeve;

(c) means for fixing said rod in said box leg member;

(d) an inner leg member slidably mounted within said sleeve and having an upper surface with means positioned on said upper surface for receiving said rod into said inner leg member;

(e) a spring element positioned around said rod, wherein one end of said spring element is positioned between said box leg member and said inner leg member, said spring biasing said inner leg member outwardly from said sleeve member; and (f) means for locking said inner leg member against further movement caused by the biasing action of said spring.

11. The leg extension assembly according to claim 10, further comprising an adaptor cover having means to attach said assembly to a separate existing leg element.

12. The leg extension assembly according to claim 11, wherein said means is in the form of at least one cinch buckle.

13. The leg extension assembly according to claim 11, wherein said cover is bolted to said existing leg element by means of a nuts and bolts assembly.

14. The leg extension assembly according to claim 11, wherein said cover is bolted to said existing leg element by means of a U-bolt assembly.

15. The leg extension assembly according to claim 10, wherein said outer sleeve member is incorporated into a leg element.

16. The leg extension assembly according to claim 10, wherein said means for connecting said box leg member and said inner leg member is in the form of a rod which is threaded at each end.

17. The leg extension assembly according to claim 10, wherein said release lever is a pivoting release lever comprising an upper end a having a spring element biasing said release lever into an engaged position, and a lower end having at least one tooth extending therefrom, said tooth being fashioned to engage an aperture in said inner leg member.

18. The leg extension assembly according to claim 17, further comprising a safety latch for holding said release lever against movement.

* * * * *